US005689881A

United States Patent [19]

Kato

[11] Patent Number: 5,689,881

[45] Date of Patent: Nov. 25, 1997

[54] FLAT TUBE FOR HEAT EXCHANGER AND METHOD FOR PRODUCING SAME

[75] Inventor: Soichi Kato, Saitama, Japan

[73] Assignee: Zexel Corporation, Tokyo, Japan

[21] Appl. No.: 589,249

[22] Filed: Jan. 23, 1996

[30] Foreign Application Priority Data

Jan. 27, 1995 [JP] Japan ..... 7-011189

[51] Int. Cl.[6] ..... B23P 15/26; F28F 1/06

[52] U.S. Cl. ..... 27/890.053; 165/177; 165/DIG. 537

[58] Field of Search ..... 165/177, 183; 29/890.053

[56] References Cited

U.S. PATENT DOCUMENTS

| | | | |
|---|---|---|---|
| 5,172,476 | 12/1992 | Joshi | 29/890.053 |
| 5,186,250 | 2/1993 | Ouchi et al. | 165/177 |
| 5,441,015 | 8/1995 | Brummett et al. | 165/153 |
| 5,514,248 | 5/1996 | Okuda et al. | 159/28.6 |

*Primary Examiner*—Allen J. Flanigan
*Attorney, Agent, or Firm*—Kanesak and Takeuchi

[57] ABSTRACT

The invention relates to a flat tube for a heat exchanger formed by folding one plate or overlaying two plates, in which long beads (16) are formed in multiple rows on the plate in its longitudinal direction, portions of the plate to which the respective long beads are opposed are formed flat, the tops of the long beads are joined with the flat portions (15) to form a plurality of channels (17) by the long beads and the flat portions, and a plurality of passages (18) which communicate adjacent channels are formed at appropriate parts on the long beads formed in the longitudinal direction of the plate. The invention also relates to a method for producing the above tube.

Thus, the plates can have their faces securely engaged, and a heat exchanger having an improved heat-exchanging efficiency can be obtained.

2 Claims, 7 Drawing Sheets

FLAT TUBE FOR HEAT EXCHANGER AND METHOD FOR PRODUCING SAME

BACKGROUND OF THE INVENTION

1. Field of the Invention

This invention relates to a flat tube for a heat exchanger, which is formed by folding one plate or overlaying two plates, and to a method for producing it.

2. Description of the Related Art

A conventional laminated heat exchanger includes plurality of flat tubes laminated, both ends of each flat tube are connected to header tanks, and a heat-exchanging medium flows in a zigzag fashion between inlet and outlet joints disposed on the header tanks.

For this type of laminated heat exchanger, flat tubes are produced, for instance, by forming many long beads 22, 22 having mutually contacted end faces on two plates 21, 21 which are made of a brazing sheet having a prescribed size, and brazing joints 23, 23 at both ends to form a flat tube 20 as shown in FIG. 7. Besides, the beads are often to be so-called round beads which are individually independent. And, it is also known to produce flat tube by folding one plate.

To braze a laminated heat exchanger using such flat tubes, a fin is positioned between a plurality of flat tubes, both ends of each flat tube are inserted into the tube insertion ports of the header tanks to assemble with a jig, and integral brazing is conducted in a furnace to join the flat tubes with the tube insertion ports for the flat tubes and the mutual top faces of the beads of the flat tubes.

When the above conventional flat tubes for a heat exchanger have the long beads as shown in FIG. 7, parts surrounded by these long beads form independent passages. Since respective passages are independent of one another, and a heating medium is not exchanged in the breadth direction of the tubes, heat efficiency is unbalanced.

On the other hand, in the case of the round beads which are individually independent, a heating medium is exchanged in the breadth direction of the tubes, remedying the disadvantage that heat efficiency is unbalanced. But, since there are a large number of independent beads, it is quite difficult to make these beads to have the same height.

A common type of flat tube which has beads formed with 3-mm pitches in 4 rows on it to a length of 600 mm has 800 beads. When a heat exchanger has 30 flat tubes, there are 24,000 beads in all. But, since each tube is formed by joining two plates, 24,000 beads mean that each heat exchanger has 48,000 beads when attention is given to the beads themselves. Since a pressure resistance is not satisfied unless all beads are brazed, these beads are particularly required to have their heights controlled. But, it is quite difficult in view of mass-production to control the heights of 48,000 beads for a single heat exchanger.

In view of above, the invention has improved a flat tube so that heat-exchanging efficiency can be improved and plates can be mutually joined securely with their entire surfaces, and, aims to provide a flat tube for a heat exchanger having improved brazability and pressure resistance, and its production method.

SUMMARY OF THE INVENTION

The first embodiment of the invention relates to a flat tube for a heat exchanger formed by folding one plate or overlaying two of the above plate, in which long beads are formed in multiple rows on the plate in its longitudinal direction, opposed portions of the plate to which the respective long beads are opposed are formed flat, the tops of the long beads are joined with the flat portions to form a plurality of channels by the long beads and the flat portions, and a plurality of passages which communicate adjacent channels are formed at appropriate parts on the long beads which are formed in the longitudinal direction of the plate.

As to a flat tube for a heat exchanger formed by folding one plate or overlaying two of the above plate, the second embodiment of the invention relates to a method for producing a flat tube for a heat exchanger, which comprises forming long beads in a plurality of rows asymmetrically with respect to the center line in the longitudinal direction of the plate by roll forming, plastically deforming appropriate parts of the long beads which are formed in the longitudinal direction of the plate in a direction to return the beads to the original shape by pressing, and overlaying two of the plate having the same shape with the beads formed to make a flat tube body.

As to a flat tube for a heat exchanger formed by folding one plate or overlaying two of the above plate, the third embodiment of the invention relates to a method for producing a flat tube for a heat exchanger, which comprises forming long beads in a plurality of rows asymmetrically with respect to the center line in the longitudinal direction of the plate and flat faces on appropriate portions of the long beads in the longitudinal direction of the plate by pressing, and overlaying two of the plate having the same shape with the beads formed to make a flat tube body.

Such a flat tube is formed by folding one plate or overlaying two of the above plate and brazing. In this case, long beads are formed prior to or at folding or overlaying of the plate by rolling, pressing or casting.

Besides, the first embodiment of the invention forms the opposed portions of the plate having the beads opposed, so that the beads are opposed to the flat portions of the plate.

And, since the above beads are long, they are suitably brazed with the flat portions of the plate and do not cause the disadvantages as described in connection with the round beads. In addition, a plurality of channels are formed by these long beads and the flat portions, and each channel is independent of the other channels, so that a heat medium flows relatively smoothly through the channels on the one hand, but the heat medium is not exchanged in the breadth direction of the tube on the other hand. But, since a plurality of passages which communicate adjacent channels are formed at appropriate parts on the long beads which are formed in the longitudinal direction of the plate, the heat medium is appropriately exchanged in the breadth direction of the tube through the passages, thereby enabling to prevent the unbalanced heat efficiency which is caused in the case of the conventional long beads.

The second embodiment of the invention, to form the flat tube, relates to a method for producing the flat tube for a heat exchanger, in which the long beads in multiple rows are asymmetrically formed with respect to the center line in the longitudinal direction of the plate by rolling, the long beads are uniformly formed in the longitudinal direction of the plate, the appropriate portions of the formed long beads are plastically deformed in the direction to return them to the original shape by pressing, two of the plate having the same shape and the long beads are overlaid to form the flat tube body. Thus, the long beads are formed uniformly and quickly by rolling, then the passages are formed. Therefore, rolling and pressing are performed efficiently.

And, to form the flat tube, the third embodiment of the invention forms the long beads in multiple rows and the flat portions disposed on the appropriate parts of the long beads in the longitudinal direction of the plate by pressing. This step can be made by a plurality of steps using a plurality of presses. But, the production can be made quickly because one press is used in one step. Basically, since it is preferable to use one press, this embodiment is suitable to produce a relatively small tube.

Thus, the invention securely engages the whole faces of plates to provide a flat tube for a heat exchanger having an improved heat efficiency and a method for producing it.

DESCRIPTION OF PREFERRED EMBODIMENTS

The invention will be described as one embodiment with reference to the attached drawings.

Figure 1:
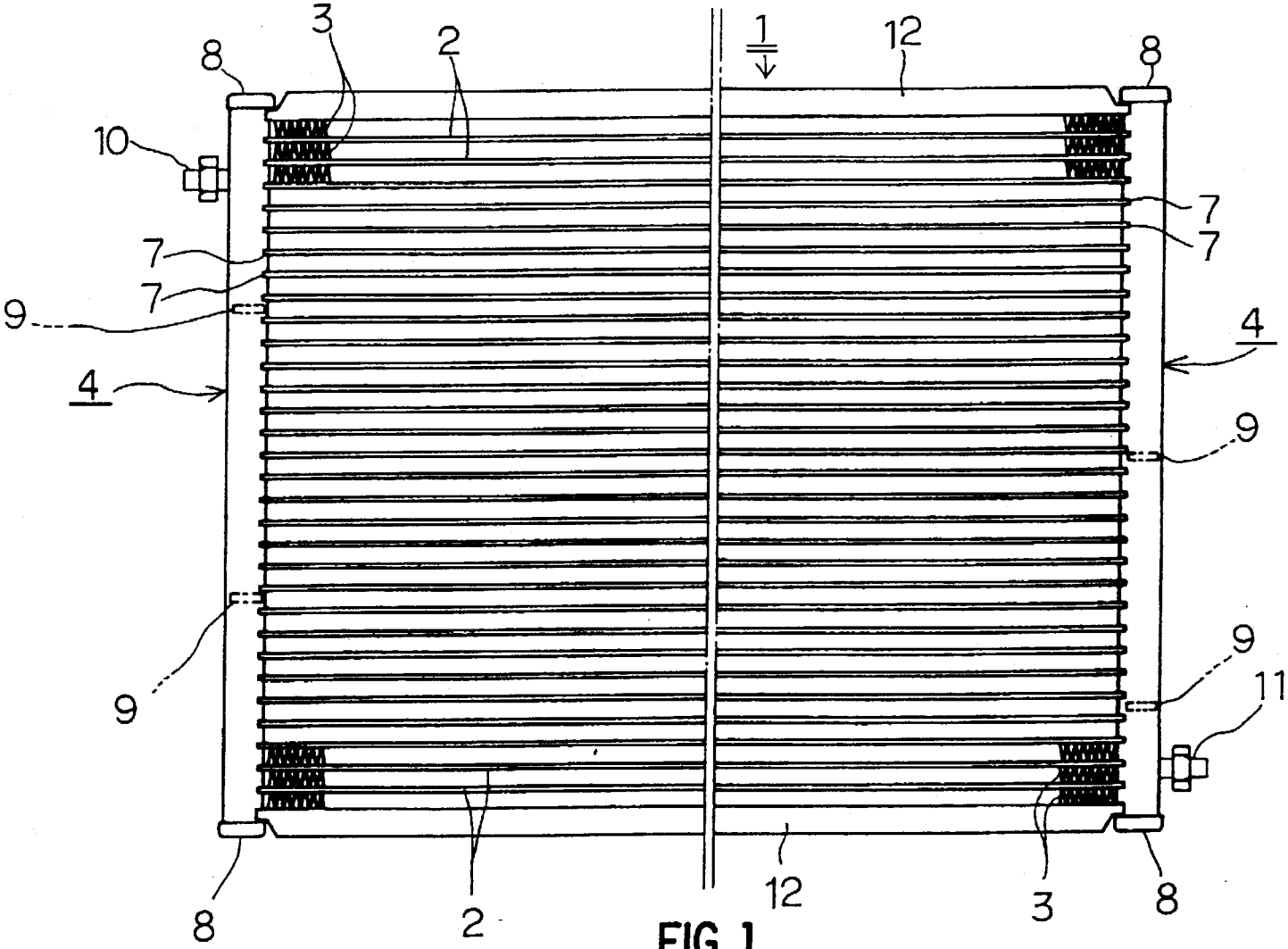
FIG. 1 is a front view of the laminated heat exchanger according to one embodiment of the invention.

In FIG. 1, a laminated heat exchanger 1 using flat tubes 2 of this embodiment has the flat tubes 2 in a large number laminated with a corrugated fin 3 therebetween.

Figure 2:
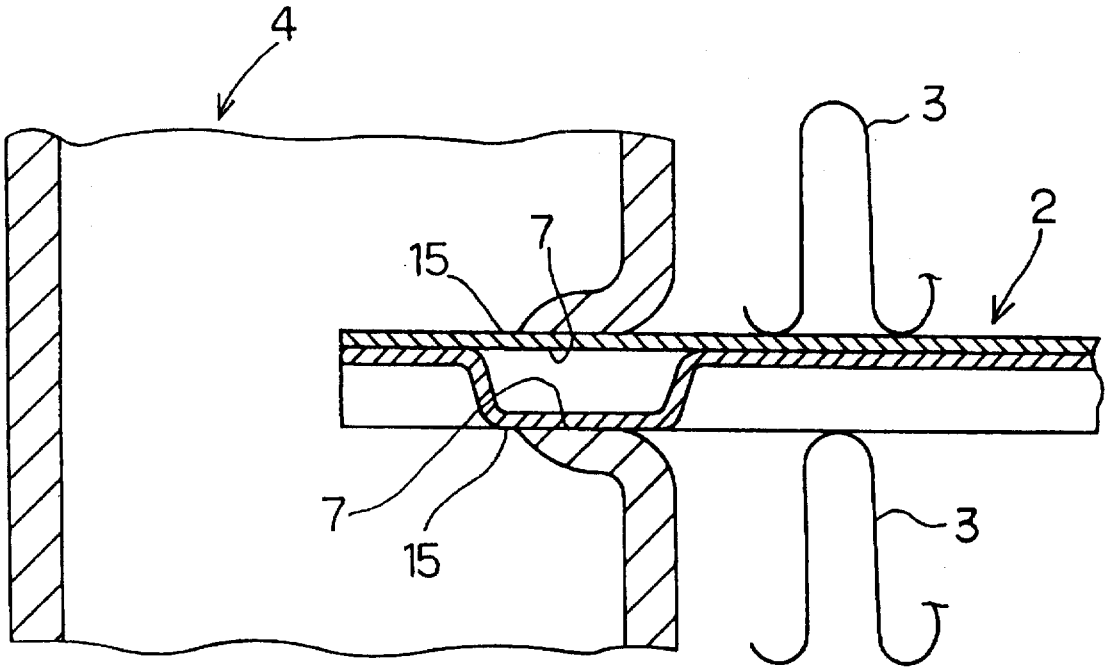
FIG. 2 is a longitudinal sectional view showing one end of a flat tube inserted into the insertion hole of a header tank.

As shown in FIG. 2, respective ends of the plurality of flat tubes 2 are inserted into insertion ports 7 which are disposed on header tanks 4 with beads joined to a flat portion 15 of a plate.

And, top and bottom openings of each header tank 4 are sealed with a blank cap 8, and partitions 9 are disposed at prescribed positions of the each header tank 4.

The header tanks 4 are provided with an inlet joint 10 and an outlet joint 11, and a heat-exchanging medium is meandered a plurality of times to flow between the inlet and outlet joints 10, 11.

In FIG. 1, reference numeral 12 designates side plates which are disposed at the top and bottom of the laminated flat tubes 2.

Figure 3:
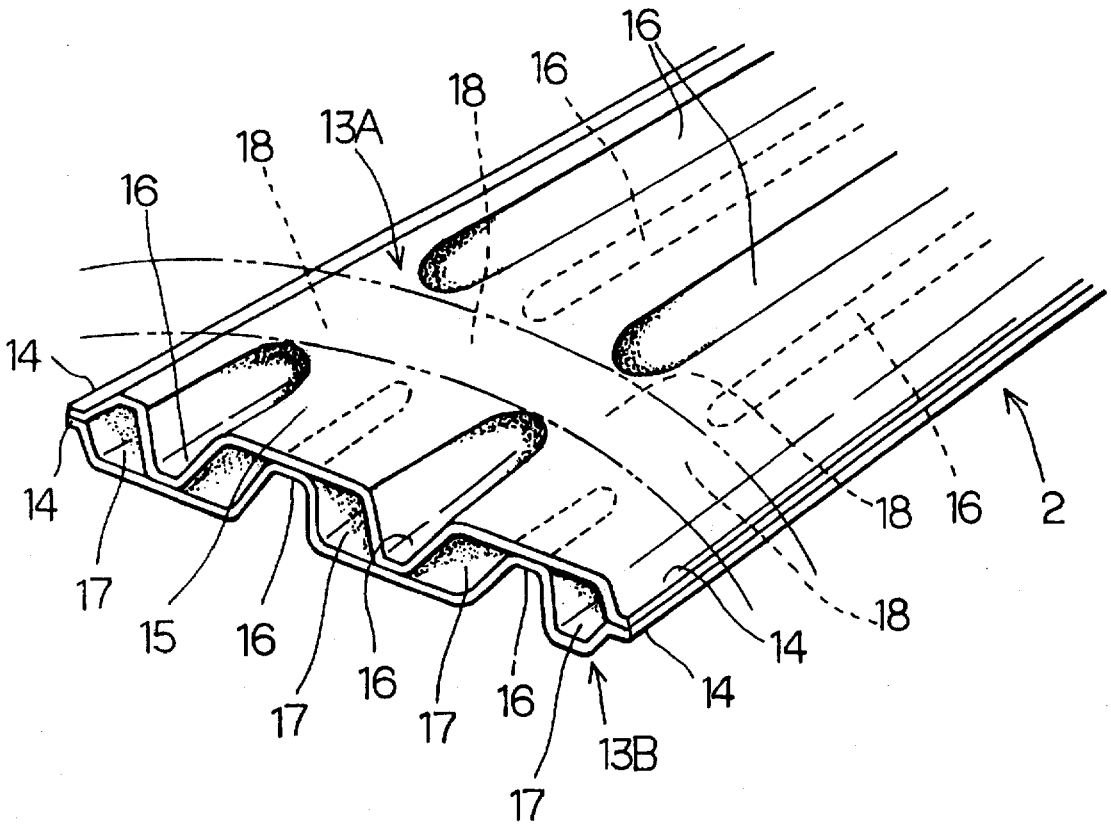
FIG. 3 is a perspective view showing a flat tube.

As shown in FIG. 3, the each flat tube 2 is formed, for instance, by continuously supplying an aluminum brazing sheet coated with a brazing material and overlaying two plates 13A, 13B which are formed into a prescribed size and shape by rolling or pressing.

These plates 13A, 13B have joints 14, 14 on their peripheries, and flat portions 15, 15 are shaped to protrude externally. Each flat portion 15 has a large number of long beads 16, 16 formed to protrude inward. This flat portion 15 uses the flat face of the material as it is, and the joints 14 and the long beads 16 are formed by rolling or pressing.

The long beads 6 are formed in a plurality of rows in the breadth direction of the flat tube 2, the applicable opposed portions of the plate opposite to the respective long beads are formed flat, the tops of the respective long beads are contacted with the flat portions, and a plurality of channels 17, 17 are formed by the long beads and the flat portions.

Besides, a plurality of passages 18 are formed on appropriate parts of the long beads 16, 16 which are formed in the longitudinal direction of the plate to communicate adjacent channels.

The above plurality of channels 17, 17 are formed by the long beads 16, 16 and the flat portions 15 (also the joints 14 at the ends) are independent of one another, so that a heat medium flows relatively smoothly through the channels and is not exchanged in the breadth direction of the tube. But, as described above, since the plurality of passages 18 are formed on appropriate parts of the long beads which are formed in the longitudinal direction of the plate to communicate the adjacent channels, the heat medium is appropriately exchanged in the breadth direction of the tube at the applicable parts, thus enabling to prevent the unbalanced heat efficiency which is caused in the case of the conventional long beads.

With a combination of the channels 17, 17 which are formed to flow the heat medium smoothly through the channels and the passages 18 which are formed to exchange the heat medium appropriately in the breadth direction of the tube, the passages 18 are preferably 10 mm or below in the longitudinal direction.

And, in the embodiment, the part (shown by two-dot chain lines in FIG. 3) which flows 13A, 13B and used to braze the plates to the header tank is formed to have a flat outer surface. In this case, the applicable flat surface is a part which was returned to be flat by plastically deforming the long beads to be described afterward. Therefore, even when the flat tube has a lot of beads, brazing can be made suitably because the header tanks and the flat tubes are brazed on the flat face of the flat tube.

The above flat face used for brazing also serves to form the passage 18. The passage 18 preferably has a size of about 5 mm in the longitudinal direction because of a bar ring at the insertion port 7 of the header tank.

Formation of the flat tube having the above structure will be described.

To form the flat tube 2, a plate 13 (13A, 13B) made of a brazing sheet having a prescribed width and wound in the form of a roll is sequentially unwound, long beads 16, 16 in a plurality of rows in the breadth direction of the tube are asymmetrically formed with respect to the center line in the longitudinal direction of the plate by rolling, and the long beads are uniformly formed in the longitudinal direction of the plate. Therefore, at this point, the long beads 16, 16 are continuously formed in the longitudinal direction of the plate 13, and the passage 18 has not been formed.

Figure 4:
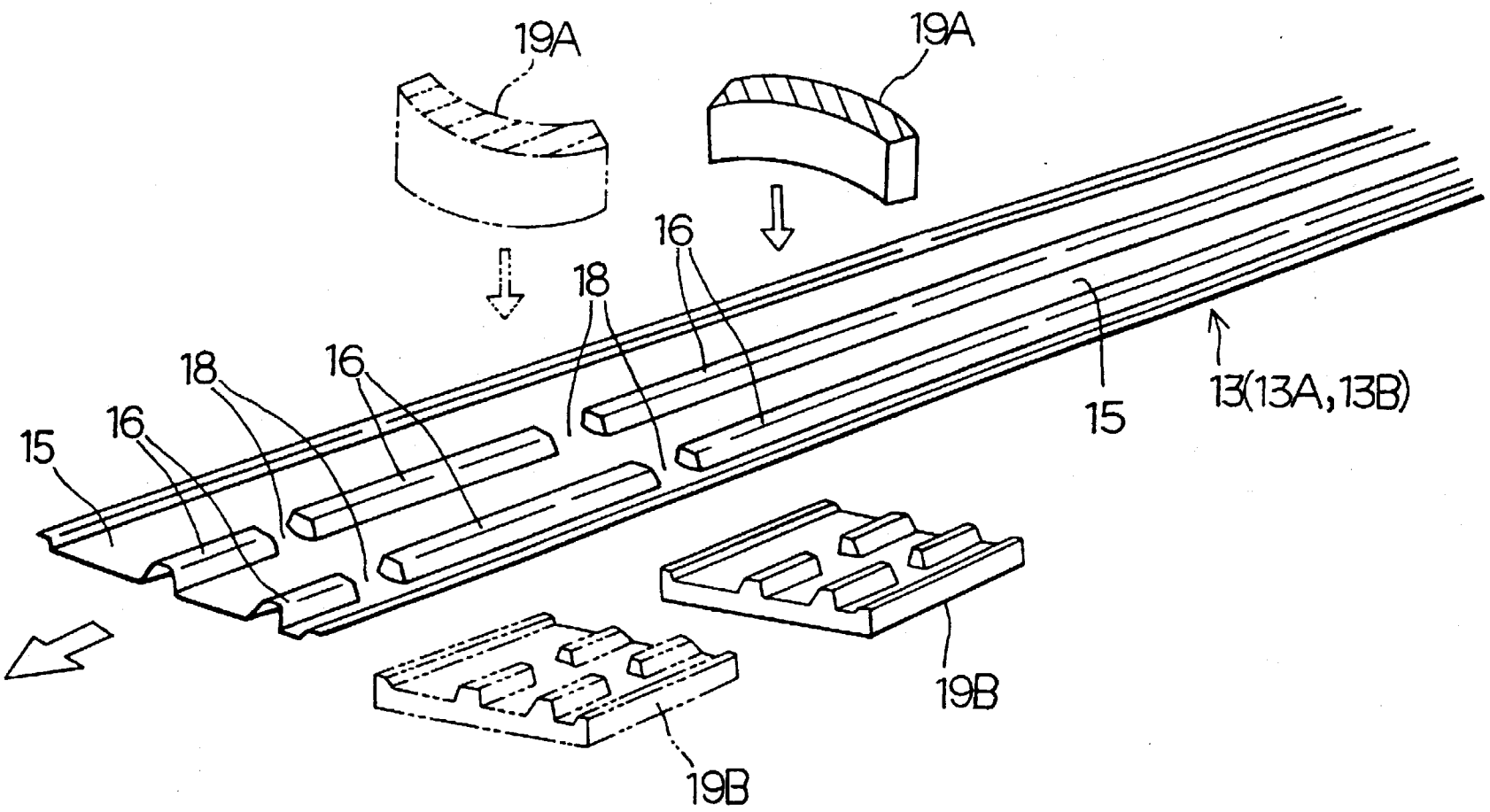
FIG. 4 is a perspective view showing a plate which forms a flat tube.

And, as shown in FIG. 4, appropriate parts of the formed long beads are plastically deformed in the direction to set the beads back to the original form by press molds 19A, 19B. In this case, the long beads are plastically deformed and formed back to the flat surface.

The upper press mold 19A has its bottom shaped to match the curved shape of the insertion hole 7 of the header tank 4. And, since the flat tube 2 has its both ends inserted into the header tanks 4 positioned at both sides, the upper press mold 19A is additionally provided with the shape symmetrical to the above curved shape.

Figure 5:
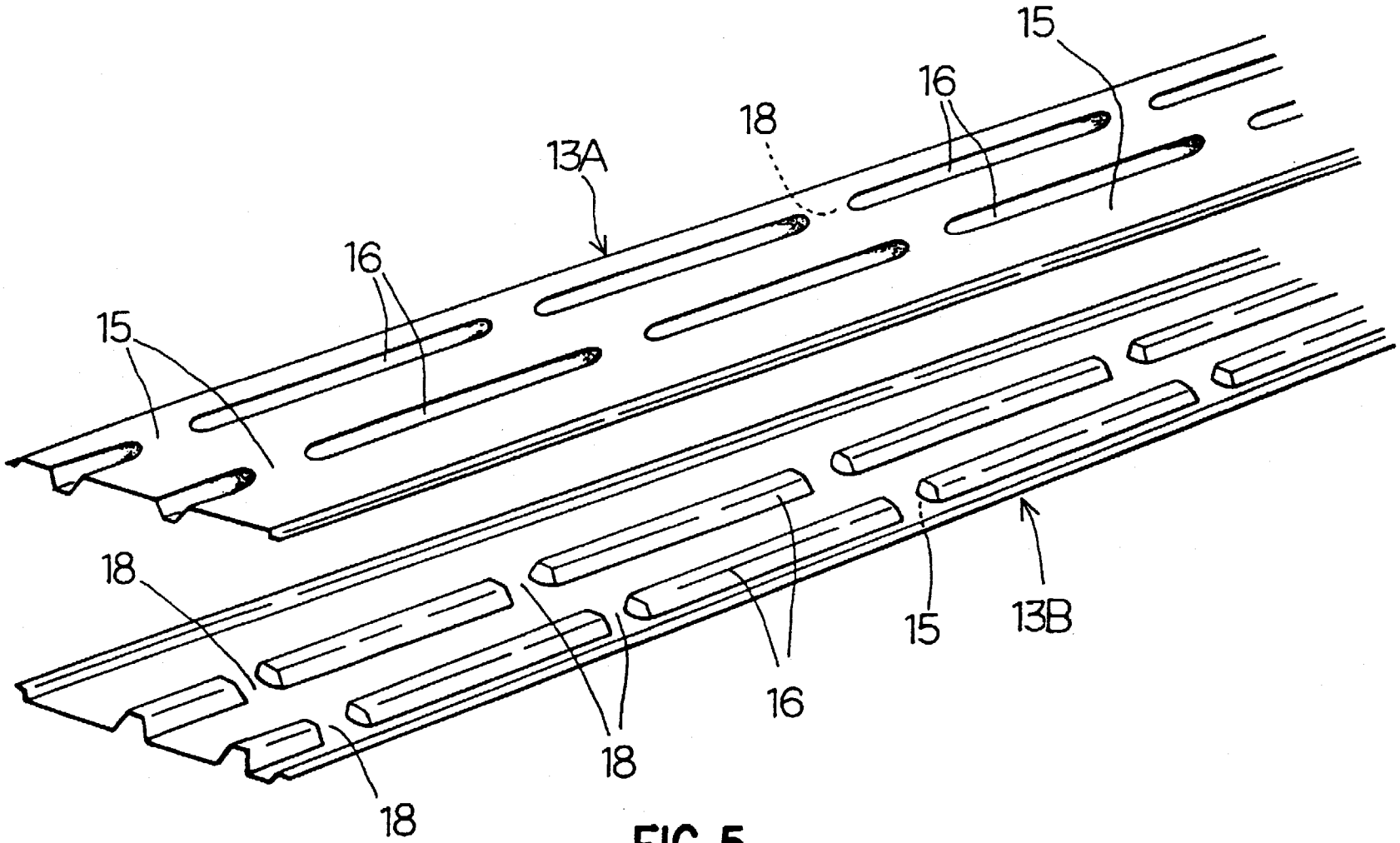
FIG. 5 is a perspective view showing a flat tube being assembled.
Figure 6:
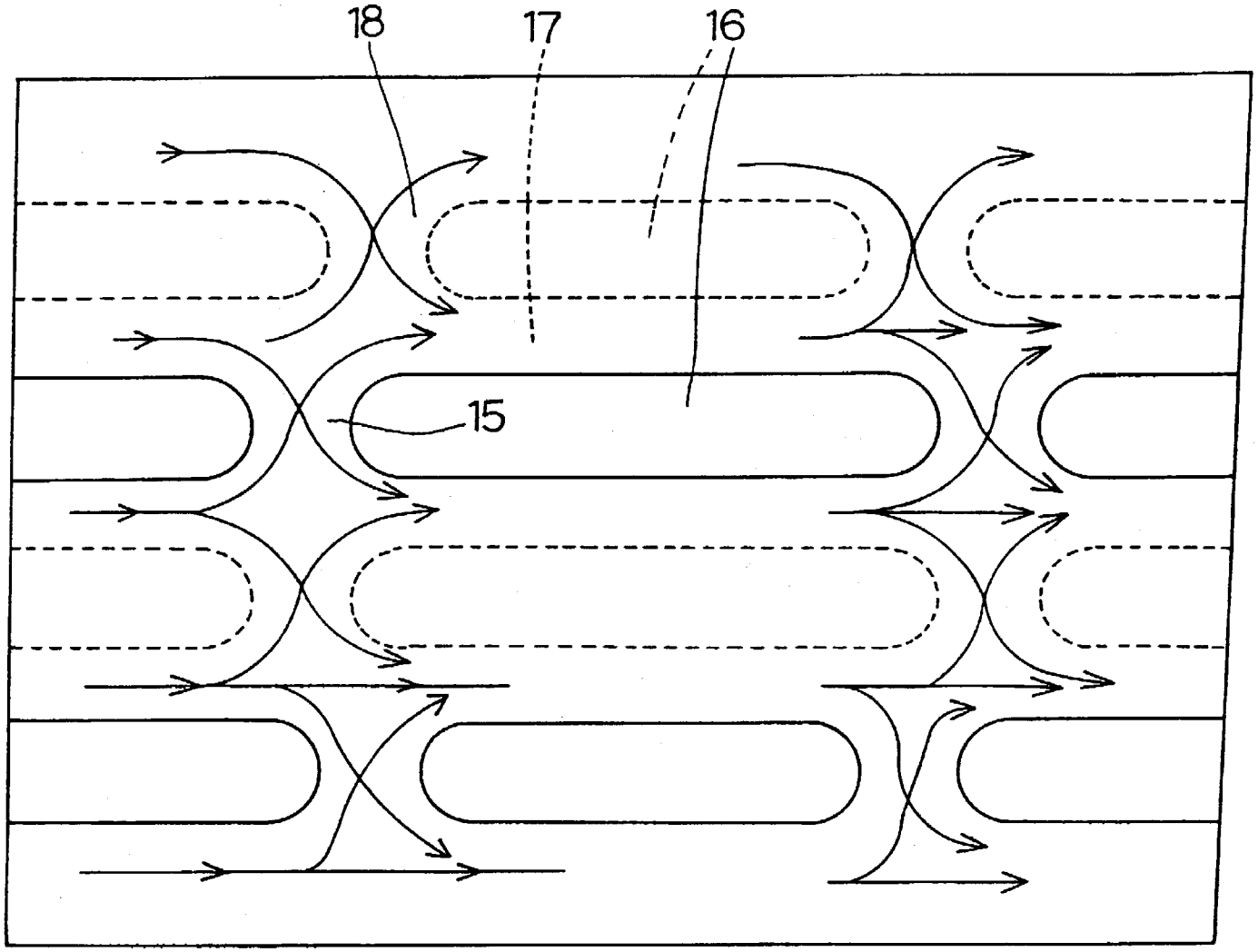
FIG. 6 is a plan view partly showing a flat tube.
Figure 7:
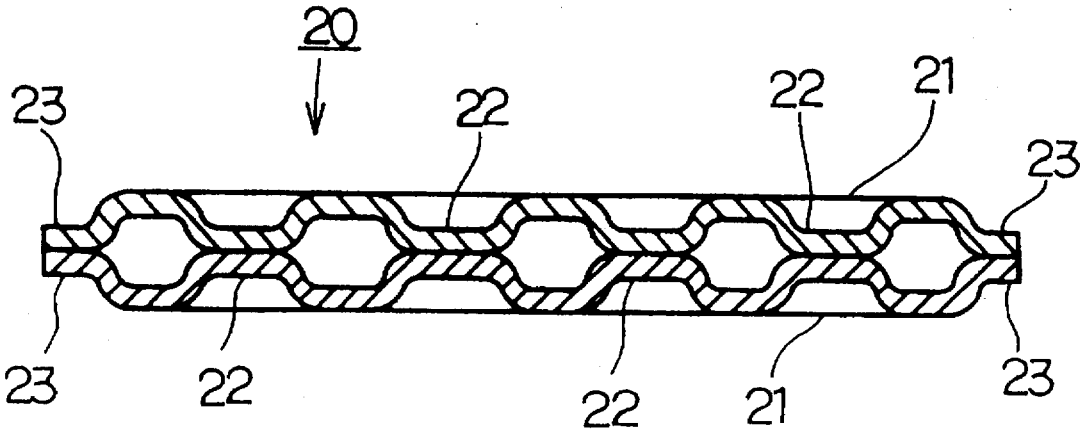
FIG. 7 is a longitudinal sectional view of a conventional flat tube.

Then, two of the above plate having the above long beads and the same shape are overlaid to form a flat tube body. As shown in FIG. 5, the plate 13A and the plate 13B have the same shape. One of them is simply turned over by 180 degrees with respect to the longitudinal direction of the other.

And, in this embodiment, the long beads 16, 16 in a plurality of rows in the breadth direction of the tube are asymmetrically formed with respect to the center line (not shown) in the longitudinal direction of the plate by rolling. When one of the plates 13 having the same shape is turned over by 180 degrees, the long beads 16 can be made to contact the flat portion 15. In other words, the flat tube can be made of one type of plate without using two types of plate having a different shape.

The flat tube 2 thus produced has the plurality of channels 17, 17 formed by the long beads 16, 16 and the flat portion 15 (also the joints 14 at the ends as described above), and the channels 17, 17 are independent of one another, so that the heat medium flows relatively smoothly through the channels. Since the plurality of passages 18 are formed on appropriate parts of the long beads which are formed in the longitudinal direction of the plate to communicate the adjacent channels, the heat medium is appropriately exchanged in the breadth direction of the tube at the applicable parts, thus enabling to prevent the unbalanced heat efficiency which is caused in the case of the conventional long beads.

In the above embodiment, the long beads 16 are formed by rolling and the passages 18 by pressing. But, to produce the flat tube, the long beads in the plurality of rows and the flat portion (including the passages 18) disposed at the appropriate parts of the long beads in the longitudinal direction of the plate may be formed by pressing. In this case, a plurality of presses may be used in a plurality of steps. But, the flat tube can be produced quickly because one press can be used in one step.

Then, the two plates 13A, 13B which are formed as described above are overlaid, and the tops of the long beads 16 are contacted to the flat portion 15 to assemble the flat tube 2.

And, both ends of the flat tubes 2 with the fin 3 held therebetween are inserted into the tube insertion ports 7 of the header tanks 4. After assembling by a jig, integral brazing is made in a furnace to connect the tube insertion holes 7 and the flat tubes 2, the joints 14, 14 of the flat tubes 2, and the long beads 16 and the flat portion 15.

Accordingly, even when the flat tube is made by overlaying two plates, the long beads 16 and the flat portion 15 which are mutually contacted are formed on the plates 13A, 13B which are contacted to each other, so that the formation of a gap between the joints of the flat tube can be prevented and they can be brazed securely.

The plates 13A, 13B have the same shape and are used symmetrically, but this embodiment is not limited to them and may use another shape.

The above embodiment has been described that the flat tube 2 is made by overlaying two plates, but not limited to them and can be applied to the flat tube which is made by folding a single plate in two.

What is claimed is:

1. A method for producing a flat tube for a heat exchanger comprising the steps of:

forming long beads on two rectangular sections of a flat plate in a plurality of rows asymmetrically with respect to a center line extending in a longitudinal direction of the plate, plastically deforming by pressing predetermined parts of the long beads so as to return the parts to the original flat plate, and overlaying the two rectangular sections so as to make a flat tube such that the long beads on one rectangular section are brought into contact with the flat plate of the other section forming parallel channels in the longitudinal direction and passages in a direction perpendicular to the longitudinal direction.

2. A method for producing a flat tube for a heat exchanger according to claim 1, wherein said plastically deforming step comprises the step of pressing the predetermined parts between upper and lower press molds, the upper press molds having curved bottom shapes which are symmetrical to each other.

* * * * *